US006330864B1

(12) United States Patent
Tajima

(10) Patent No.: US 6,330,864 B1
(45) **Date of Patent: *Dec. 18, 2001**

(54) SEWING MACHINE WITH IMPROVED FRAME DRIVE DEVICE

(75) Inventor: Ikuo Tajima, Kasugai (JP)

(73) Assignee: Tokai Kogyo Mishin Kabushiki Kaisha (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/532,920

(22) Filed: Mar. 22, 2000

(30) Foreign Application Priority Data

Mar. 23, 1999 (JP) ..... 11-078175

(51) Int. Cl.[7] ..... D05B 21/00; D05B 25/00
(52) U.S. Cl. ..... 112/470.18; 112/155
(58) Field of Search ..... 112/470.06, 470.18, 112/470.14, 102.5, 155, 103

(56) References Cited

U.S. PATENT DOCUMENTS 4,649,837 * 3/1987 Futsuhara ..... 112/470.06
5,408,944 * 4/1995 Hayashi ..... 112/103
5,553,545 9/1996 Ono et al. ..... 05/21

FOREIGN PATENT DOCUMENTS 62-139693 6/1987 (JP) .
274321 4/1996 (TW) .

* cited by examiner

*Primary Examiner*—Peter Nerbun
(74) *Attorney, Agent, or Firm*—Lyon & Lyon LLP

(57) ABSTRACT

A sewing machine includes a frame for supporting a fabric to be sewn and a drive device for moving the frame. The drive device includes an X-drive mechanism for moving the frame in X-direction and a Y-drive mechanism for moving the frame in Y-direction that is perpendicular to the X-direction. Each of the X-drive mechanism and the Y-drive mechanism preferably includes a linear motor as a drive source. A machine table is positioned below the frame. The linear motor of each of the X-drive mechanism and the Y-drive mechanism is disposed below the machine table.

29 Claims, 4 Drawing Sheets

SEWING MACHINE WITH IMPROVED FRAME DRIVE DEVICE

BACKGROUND OF THE INVENTION

1. Field of the Invention

The present invention relates to sewing machines, and in particular, to sewing machines having a drive device for moving a fabric-supporting frame in both the X-direction and the Y-direction, which is perpendicular to the X-direction.

2. Description of the Related Art

Many known drive devices for moving a fabric supporting frame include an X-drive mechanism and a Y-drive mechanism, each of which have a rotary motor, such as a pulse motor and a servo-motor, as a drive source. Therefore, a conversion mechanism is necessary to convert the rotary movement of the motor into a linear movement to move the frame in the X and Y directions. Such a motion conversion mechanism may include for example a belt and pulley mechanism, a wire and pulley mechanism or a ball-screw mechanism.

Another type of known device for moving a fabric supporting frame includes a linear motor as the drive source for the X-drive mechanism. However, the known sewing machines still require a rotary drive source and a motion conversion mechanism as the Y-drive mechanism in order to move the frame in the Y-direction. Thus, the Y-drive mechanism is the same as the above-described known devices. More specifically, the Y-drive mechanism of this type of drive device includes a belt and pulley mechanism that has a carrier mounted to a belt. The linear motor of the X-drive mechanism is supported on the carrier and has a movable member, to which a fabric supporting frame of a relatively small size is mounted. A representative example of such a sewing machine is described in Japanese Laid-Open Patent Publication No. 62-139693.

The incorporation of the motion conversion mechanism (s) complicates the construction of the drive device. In addition, due to the backlash among the mechanical parts of the motion conversion mechanism, it is difficult to improve the accuracy of the frame driving control. Although a ball-screw mechanism may be incorporated as a motion conversion mechanism to improve the accuracy of the driving control, ball-screw mechanisms are generally expensive, which can increase the manufacturing cost of the drive device.

Further, in the known drive device incorporating the linear motor as the drive source of the X-drive mechanism, the Y-drive mechanism still requires a motion conversion mechanism, which may cause backlash among the mechanical parts or may increase the manufacturing costs of producing the sewing machine with a linear motor.

SUMMARY OF THE INVENTION

It is, accordingly, one object of the present invention to teach improved sewing machines, in which a fabric support frame can be moved without use of a motion conversion mechanism that converts rotary movement into linear movement.

According to the present invention, improved sewing machines are taught that include a drive device, which has linear motors as drive sources for moving a fabric support frame in both the X-direction and the Y-direction. As a result, a motion conversion mechanism is not needed to convert rotary movement of the motor into linear movement.

Therefore, the drive device may have a relatively simple construction and the driving accuracy of the frame can be improved.

In a preferred representative embodiment, a movable member of the linear motor of the X-drive mechanism is connected to the frame such that the frame can move together with the movable member in the X-direction and can move relative to the movable member in the Y-direction. Similarly, a movable member of the linear motor of the Y-drive mechanism is connected to the frame such that the frame can move together with the movable member in the Y-direction and can move relative to the movable member in the X-direction. Therefore, the frame can move in the X-direction and the Y-direction by the X-drive mechanism and the Y-drive mechanism, respectively, without interference between the X-drive mechanism and the Y-drive mechanism.

Preferably, rollers are mounted on the movable members of the X-drive mechanism and the Y-drive mechanism so as to engages recesses formed in the frame in the Y-direction and the X-direction, respectively.

Other objects, features and advantages of the present invention will be readily understood after reading the following detailed description together with the accompanying drawings and the claims.

DETAILED DESCRIPTION OF THE INVENTION

Figure 1:
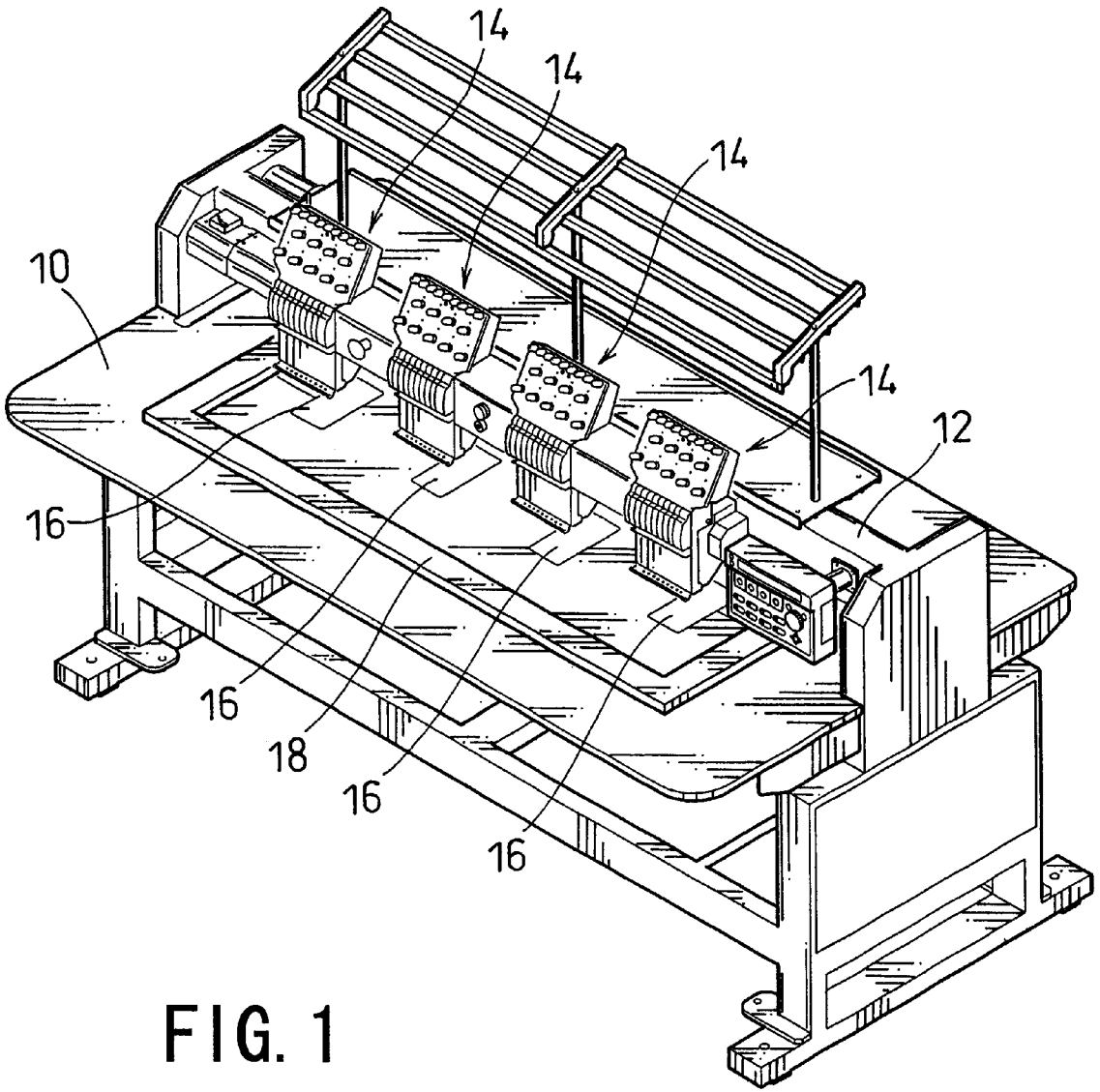
FIG. 1 is a perspective view of a representative multi-head sewing machine.

Sewing machines are taught that can simplify the construction of a frame drive device and that can improve the driving accuracy of the frame. Preferably, the drive device includes an X-drive mechanism for moving the frame in the X-direction and a Y-drive mechanism for moving the frame in the Y-direction. Each of the X-drive mechanism and the Y-drive mechanism preferably include a linear motor as a drive source. Therefore, no motion conversion mechanism is needed to convert rotary movement into linear movement.

In a preferred representative embodiment, the linear motor includes a fixed base plate, a stator mounted on the base plate, a pair of linear rails disposed on both sides of the stator, and a movable member that can move linearly relative to the stator along the linear rails. Preferably, a space or gap is magnetically maintained between the movable member and the stator to allow the movable member to move smoothly along the stator.

A first connecting mechanism may connect the movable member of the X-drive linear motor to the frame such that the frame can move together with the movable member in the X-direction and can also move relative to the movable member in the Y-direction. A second connecting mechanism may connect the movable member of the Y-drive linear motor to the frame such that the frame can move together with the movable member in the Y-direction and can move relative to the movable member in the X-direction.

Preferably, the first connecting mechanism includes a first roller mounted on the movable member of the X-drive mechanism and includes a first recess formed in the frame in the Y-direction, which first recess can engage the first roller. The second connecting mechanism may include a second roller mounted on the movable member of the Y-drive mechanism and may include a second recess formed in the frame in the X-direction, which second recess can engage the second roller.

The sewing machine may include a machine table positioned below the frame, and the linear motors of the X-drive mechanism and the Y-drive mechanism may be disposed below the machine table. Moreover, the drive devices may include a plurality of the X-drive mechanisms spaced from each other in the Y-direction and a plurality of the Y-drive mechanisms spaced from each other in the X-direction.

The sewing machine may be a multi-head sewing machine that includes a plurality of sewing heads, each of which is operable to form stitches.

Each of the additional features and method steps disclosed above and below may be utilized separately or in conjunction with other features and method steps to provide improved sewing machines and methods for designing and using such sewing machines. A representative example of the present invention, which example utilizes many of these additional features and method steps in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention.

A representative embodiment of a sewing machine will now be described with reference to the drawings. FIG. 1 illustrates a perspective view of a multi-head sewing machine that may include a machine table 10. A machine frame 12 may extend horizontally above the machine table 10. A plurality of sewing heads 14 (four sewing heads are shown in the representative embodiment) may be mounted on the machine frame 12 in a spaced relationship with each other. Throat plates 16 may be mounted on the table 10 and may oppose the respective sewing heads 14 in the vertical direction. Shuttles (not shown) may be disposed below the throat plates 16 and may cooperate with the respective sewing heads 14 to perform sewing operations in a known manner. Preferably, each of the sewing heads 14 has a plurality of needle bars that provide a plurality of different kinds of threads, such as for example different colored threads. Therefore, appropriate needle bars can be selected to cooperate with the corresponding shuttle to form stitches of various colors.

A fabric-supporting frame 18 may have a substantially rectangular configuration and may serve to support a fabric to be embroidered. The frame 18 may be disposed on an upper surface of the machine table 10. A drive device may be associated with the frame 18, so that the frame 18 can move along the upper surface of the machine table 10 within a horizontal plane in both the X-direction and the Y-direction, which is perpendicular to the X-direction as shown in FIG. 2.

Figure 2:
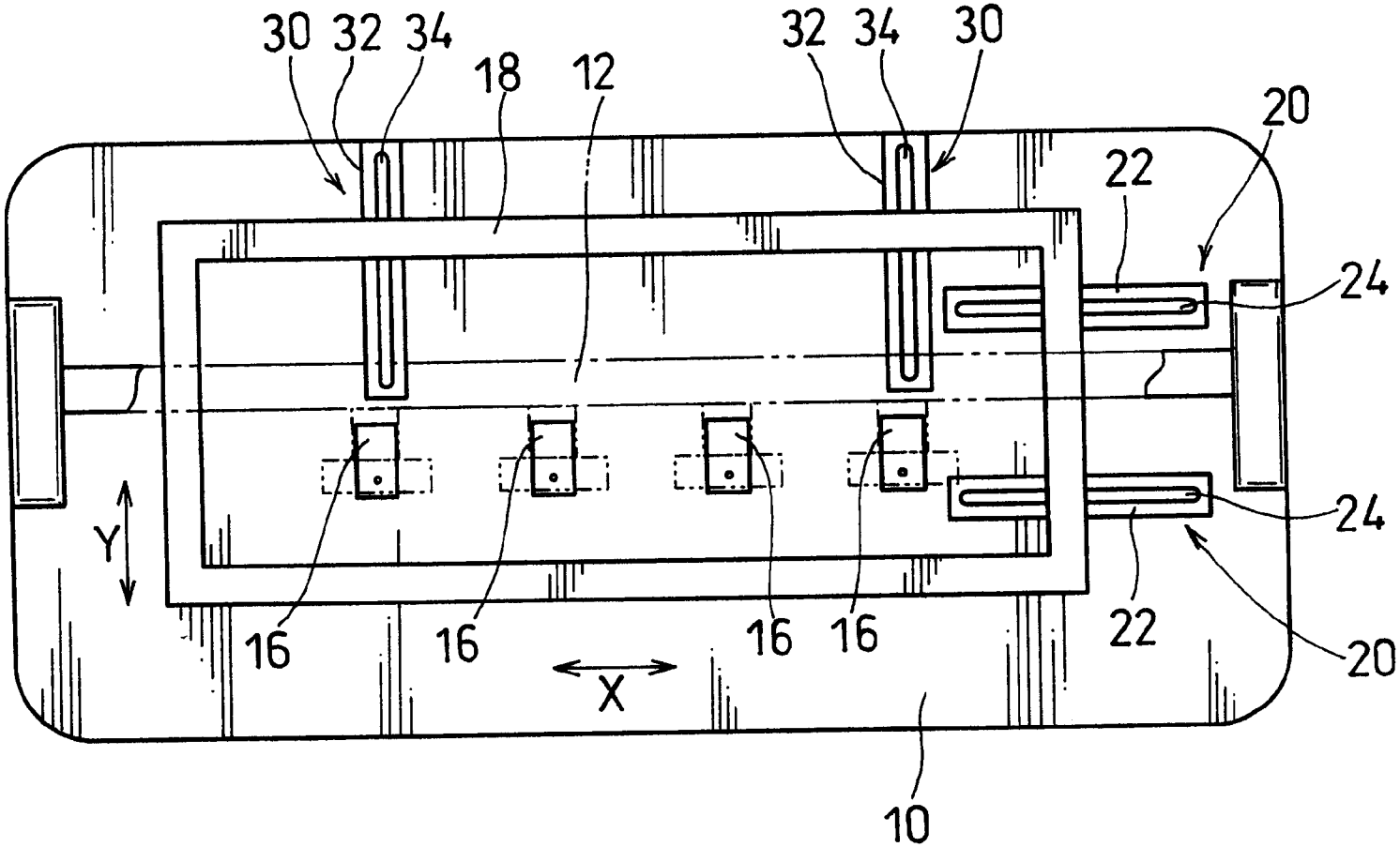
FIG. 2 is a plan view of the representative sewing machine.

Referring to FIG. 2, the drive device may comprise two X-drive mechanisms 20 and two Y-drive mechanisms 30. Each of these drive mechanisms may have respective drive sources or linear motors that are disposed below the machine table 10. Detachable lids 22 and 33 may be mounted on the machine table 10 so as to close corresponding openings formed in the machine table 10. In addition, a slit or opening 24 may be formed in each lid 22, which slit or opening 24 preferably extends in the X-direction. Similarly, a slit or opening 32 also may be formed in each lid 32, which slit or opening 32 preferably extends in the Y-direction.

Figure 3:
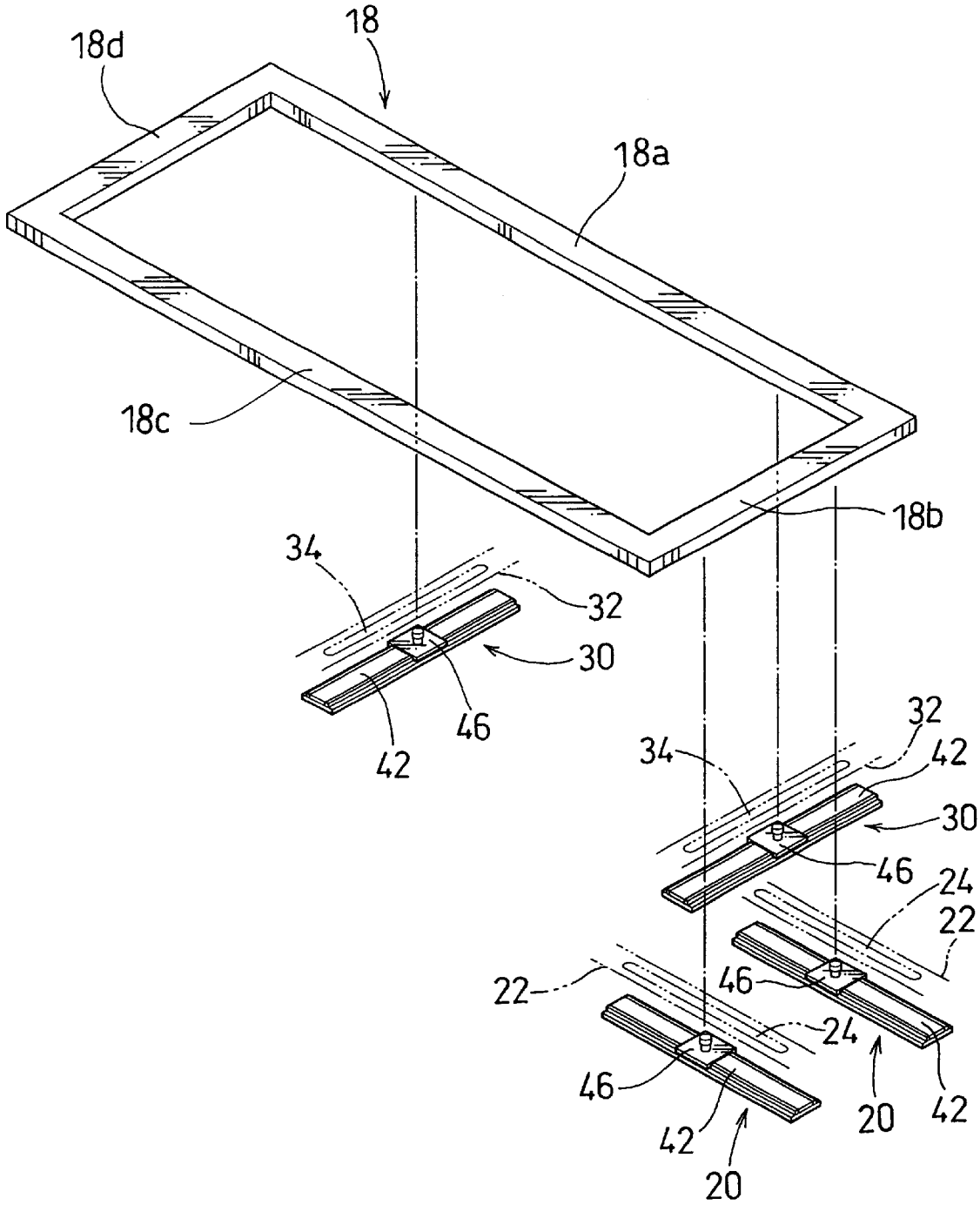
FIG. 3 is an exploded perspective view of a fabric supporting frame and a drive device including linear motors.
Figure 4:
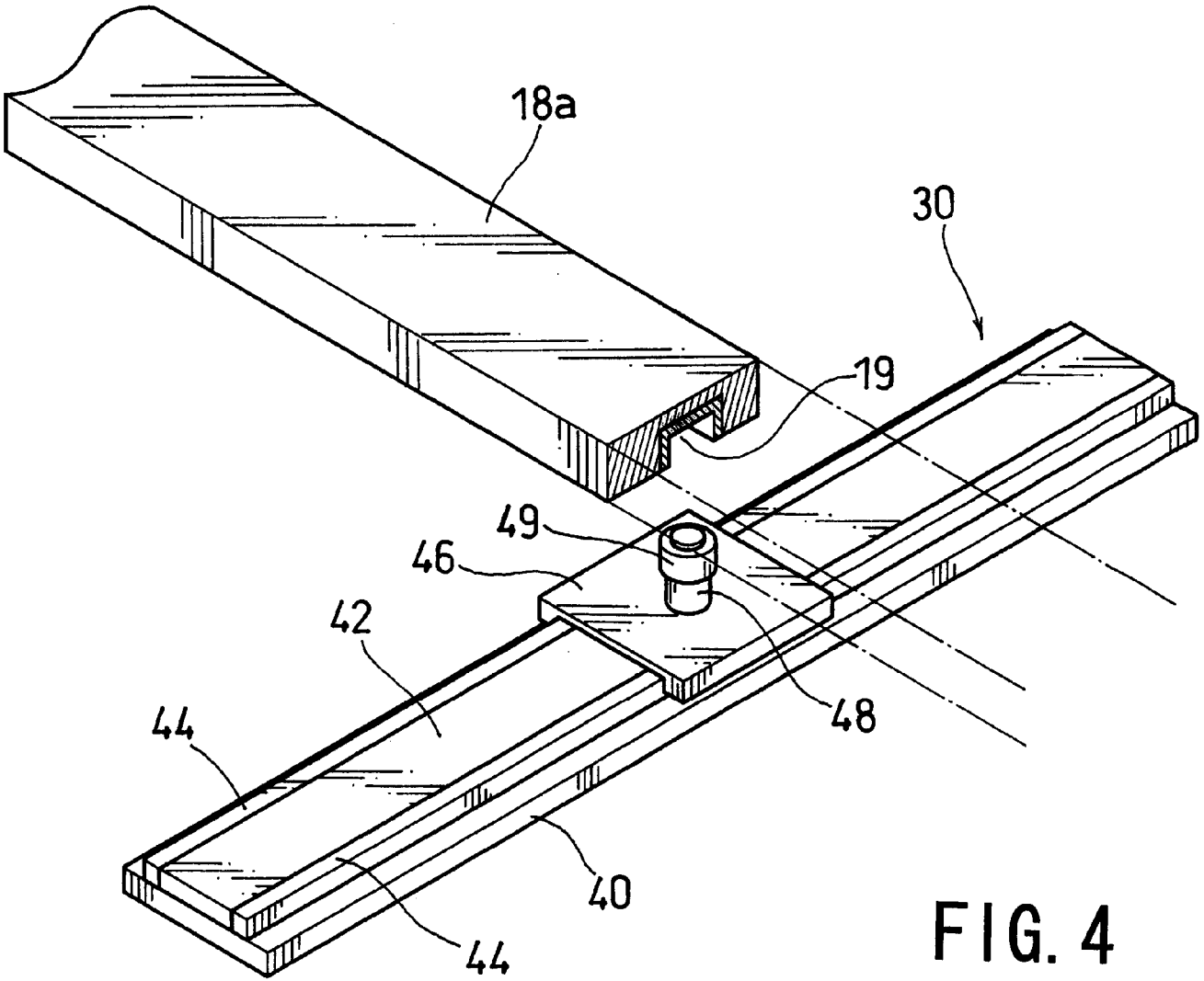
FIG. 4 is an exploded perspective view of a part of the frame and a Y-drive mechanism.

A representative arrangement of the X-drive mechanisms 20 and the Y-drive mechanisms 30 is shown in more detail in FIG. 3 in relation to the frame 18. In this representative example, the two X-drive mechanisms 20 and the two Y-drive mechanisms have the same construction. Therefore, for illustrative purposes, it is only necessary to describe the construction of a single representative drive mechanism. As shown in FIG. 4, Y-drive mechanism 30 will be explained in further detail and it is not necessary to particularly describe the X-drive mechanisms 20, because the X-drive mechanisms 20 may be identical to the Y-drive mechanism 30 shown in FIG.4. However, persons skilled in the art will recognize that other constructions may be utilized to practice the present invention.

As shown in FIGS. 3 and 4, each of the Y-drive mechanisms 30 may include a base plate 40 that extends in the Y-direction (X-direction for the base plate 40 of the X-drive mechanisms 20). A stator 42 may be secured to the upper side of the base plate 40 and may extend in the longitudinal direction of the base plate 40. A pair of linear rails 44 is mounted on the sides of the stator 42. Under the control of a control device (not shown), a movable member 46 can move in the Y-direction along the linear rails 44. A small gap is magnetically maintained between the movable member 46 and the upper surface of the stator 42. Thus, the stator 42, the linear rails 44 and the movable member 46 may constitute the linear motor.

Although various linear motors may be utilized with the present teachings, the linear motor preferably includes a movable member 46 having a permanent magnet (now shown) that is secured to the inner side of the movable member 46. The stator 42 preferably has magnetic coils (not shown) arranged in series in the longitudinal direction of the stator 42. The linear motor may operate by changing the magnetic fields produced by the magnetic coils, such that the magnetic coil opposing the permanent magnet repulses the permanent magnet of the movable member 46. At the same time, the permanent magnet will be attracted by the magnetic field produced by the magnetic coil that is position adjacent to the permanent magnet. Because the operation of such magnetic linear motors is well known in the art, it is not necessary to describe linear motors in further detail.

The Linear Motor Table, part number TSLM A and/or A/G, distributed by Nippon Tomuson Kabushiki Kaisha is a representative linear motor that can be utilized with the present teachings to obtain a sewing machine having X-drive and Y-drive linear motors.

Returning to FIG. 4, a pin 48 may be secured to the movable member 46 and may extend upward in the vertical direction. A roller 49 may be mounted on upper end of the pin 48, so that the roller 49 can rotate about the axis of the pin 48. The roller 49 and the upper portion of the pin 48 may extend above the machine table 10 through the slit 34 of the lid 32 (the slit 24 of the lid 22 in case of the X-drive mechanisms 20). A linear scale (not shown) may be affixed to one of the linear guide rails 44 in the longitudinal direction, so that the position of the movable member 46 can be detected by means of a sensor (not shown) based on the position relative to the scale. Thus, position control of the movable member 46 can be performed based on position signals from the sensor.

Referring again to FIG. 4, a recess 19 may extend along the lower surface of one X-direction side 18*a* of the frame 18 for a predetermined length. Although not shown in the drawings, the same recess 19 may extend along the lower surface of one Y-direction side 18*b* of the frame 18 for a predetermined length. The sizes of the rollers 49 are preferably selected so as to substantially and closely engage the respective recesses 19. More specifically, the rollers 49 of the X-drive mechanisms 20 may engage the recess 19 of the Y-direction side 18*b* of the frame 18. Similarly, the rollers 49 of the Y-drive mechanisms 30 may engage the recess 19 of the X-direction side 18*a* of the frame 18.

The linear motors of the X-drive mechanisms 20 and the Y-drive mechanisms 30 may be electrically connected to a controller, so that the X-drive mechanisms 20 can move the frame 18 in the X-direction in synchronism with each other and the Y-drive mechanisms 30 can move the frame 18 in the Y-direction in synchronism with each other. In addition, the controller may outputs drive signals to the linear motors, so that the X-drive mechanisms 20 and the Y-drive mechanisms 30 can move the frame 18 in X and Y-directions based on the drive signals. The drive signals may correspond to X-Y coordinate data of an embroidery pattern to be stitched. As a result, the frame 18 can be accurately moved to the programmed X-Y coordinate position.

The above preferred embodiment may be modified in various ways. For example, the base plate 40 or the stator 42 may have a long length, so that one or more additional movable members 46 can be incorporated into each of the X-drive mechanisms 20 or the Y-drive mechanisms 30. In addition, a recess similar to recess 19 also may be formed in the lower surface of a X-direction side 18*c* opposite to the X-direction side 18*a* or a Y-direction side 18*d* opposite to the Y-direction side 18*b* of the frame 18 in order to engage the rollers 49 of the additional movable members 46. As a result, during the movement of the frame 18, the configuration of the frame 18 can be reliably maintained by the rollers 49 that engage the respective recesses 19 of both sides 18*a* and 18*c* in X-direction or both sides 18*b* and 18*d* in Y-direction. Therefore, a rigid frame 18 is not required and a flexible frame 18 can be utilized with the present teachings.

Alternatively, additional X-drive mechanisms 20 or additional Y-drive mechanisms 30 may be incorporated and may also have rollers 49. Moreover, a recess similar to recess 19 may be formed in the lower surface of the X-direction side 18*c* or Y-direction side 18*d* of the frame 18 to engage the rollers 49.

Further, the connecting mechanism or the rollers 49 and the recesses 19 between the Y-drive mechanisms 30 and the X-direction side 18*a* can be replaced with a connecting mechanism that includes a connecting plate secured to both moving members 46 of the Y-drive mechanisms 30. The connecting plate may have a length that is longer than X-direction side 18*a* and may be connected to the X-direction side 18*a,* such that the frame 18 can be moved in the Y-direction together with the connecting plate by the Y-drive mechanisms 30. Similarly, the frame preferably can move relative to the connecting plate in the X-direction by the X-drive mechanisms 20. Because of the incorporation of the connecting plate that is longer than X-direction side 18*a,* the entire side 18*a* can be supported by the connecting plate during the movement of the frame 18. Therefore, the frame 18 may not deform during its movement even if the frame 18 is not very rigid.

Similar replacement can also be made to the connecting mechanism or the rollers 49 and the recesses 19 between the X-drive mechanisms 20 and the Y-direction side 18*b*. Thus, a connecting plate may be secured to both moving members 46 of the X-drive mechanisms 20. The connecting plate may be longer than Y-direction side 18*b* and may be connected to the Y-direction side 18*b,* such that the frame 18 can move in the X-direction together with the connecting plate by the X-drive mechanisms 20. Further, the frame 18 can move relative to the connecting plate in the Y-direction by the Y-drive mechanisms 30.

Although in the representative embodiment of the sewing machine, the frame 18 has been adapted to support a fabric to be embroidered in a flat stretched form, the present invention also may be applied to sewing machines that have a frame for supporting a tubular fabric, such as a T-shirt, a curved fabric or a cap. In such a case, the linear movement of the X-drive mechanisms 20 may be converted into the rotary movement of the frame about an axis that is parallel to the Y-direction. The frame can move linearly in the Y-direction by the Y-drive mechanisms.

What is claimed is:

1. A sewing machine comprising:

a frame for supporting a fabric to be sewn;

a drive device for moving the frame;

the drive device comprising an X-drive mechanism for moving the frame in an X-direction and a Y-drive mechanism for moving the frame in an Y-direction, each of the X-drive mechanism and the Y-drive mechanism including a linear motor as a drive source; and a machine table positioned below the frame, wherein the linear motor of each of the X-drive mechanism and the Y-drive mechanism is disposed below the machine table.

2. A sewing machine as in claim 1, wherein at least one linear motor includes a fixed base plate, a stator mounted on the base plate, a linear rail disposed on each side of the stator, and a movable member than can move linearly relative to the stator along the linear rails, wherein a gap is magnetically maintained between the movable member and the stator.

3. A sewing machine as in claim 2, further including:

a first connecting mechanism for connecting the movable member of the linear motor of the X-drive mechanism to the frame, whereby the frame can move together with the movable member in the X-direction and can move relative to the movable member in the Y-direction; and a second connecting mechanism for connecting the movable member of the linear motor of the Y-drive mechanism to the frame, whereby the frame can move together with the movable member in the Y-direction and can move relative to the movable member in the X-direction.

4. A sewing machine as in claim 3, where the frame includes a first recess formed in the Y-direction and a second recess formed in the X-direction, the first connecting mechanism includes a first roller mounted on the movable member of the X-drive mechanism and the first roller engages the first recess and the second connecting mechanism includes a second roller mounted on the movable member of the Y-drive mechanism and the second roller engages the second recess.

5. A sewing machine as in claim 1, wherein the drive device includes a plurality of the X-drive mechanisms spaced from each other in the Y-direction and includes a plurality of the Y-drive mechanisms spaced from each other in the X-direction.

6. A sewing machine as in claim 1, wherein the sewing machine includes a plurality of sewing heads, each operable to form stitches.

7. An apparatus comprising:

a sewing head that is fixed in position, a frame that can move relative to the sewing head, a first linear motor coupled to the frame to move the frame in a first direction, a second linear motor coupled to the frame to move the frame in a second direction, wherein the second direction is perpendicular to the first direction and a machine table positioned below the frame, wherein the first and second linear motors are disposed below the machine table.

8. An apparatus as in claim 7, wherein the first and second linear motor each comprise a fixed base plate, a stator mounted on the base plate, linear rails disposed on each side of the stator, and a movable member that can move linearly relative to the stator along the linear rails, wherein a gap is magnetically maintained between the movable member and the stator.

9. An apparatus as in claim 8, further comprising:

first means for connecting the movable member of the first linear motor to the frame, wherein the frame is adapted to move together with the movable member in the first direction and is adapted to move relative to the movable member in the second direction, and second means for connecting the movable member of the second linear motor to the frame, wherein the frame is adapted to move together with the movable member in the second direction and is adapted to move relative to the movable member in the first direction.

10. An apparatus as in claim 9, wherein the first connecting means comprises a first roller mounted on the movable member of the first linear motor and a first recess formed in the frame in the second direction to engage the first roller, and wherein the second connecting means comprises a second roller mounted on the movable member of the second linear motor and includes a second recess formed in the frame in the first direction to engage the second roller.

11. An apparatus as in claim 7, further comprising a plurality of first linear motors spaced from each other in the second direction and a plurality of the second linear motors spaced from each other in the first direction.

12. A sewing machine as in claim 7, wherein the apparatus includes a plurality of sewing heads, each operable to form stitches.

13. A sewing machine, comprising:

a plurality of sewing heads that are fixed in position, a frame that can move relative to the sewing heads in a first direction and a second direction, wherein the first direction is perpendicular to the second direction, the frame having a first recess longitudinally formed in the second direction and a second recess longitudinally formed in the first direction, a plurality of first linear motors spaced from each other in the second direction, a plurality of second linear motors spaced from each other in the first direction, wherein the first and second linear motors each comprise:

a fixed base plate, a stator mounted on the base plate, a pair of linear rails disposed on sides of the stator, and a movable member that can move linearly relative to the stator along the linear rails, wherein a gap is magnetically maintained between the movable member and the stator, a plurality of first rollers engaging the first recess, wherein one first roller is disposed on the movable member of each of the respective first linear motors and a plurality of second rollers engaging the second recess, wherein one second roller is disposed on the movable member of each of the respective second linear motors.

14. A sewing machine as in claim 13, further comprising a machine table positioned below the frame, wherein the first and second linear motors are disposed below the machine table.

15. A sewing machine, comprising:

a sewing head;

a frame adapted to move relative to the sewing head in a first direction and a second direction, wherein the first direction is perpendicular to the second direction, the frame having a first recess longitudinally formed in the second direction;

a first linear motor comprising a movable member, wherein the first linear motor is adapted to move the frame in the second direction; and a first roller disposed on the movable member and engaging the first recess of the frame.

16. A sewing machine as in claim 15, wherein the first linear motor comprises:

a fixed base plate, a stator mounted on the base plate and a linear rail disposed on each side of the stator, wherein the movable member is adapted to move linearly relative to the stator along the linear rails and a gap is magnetically maintained between the movable member and the stator.

17. A sewing machine as in claim 15, further comprising a machine table positioned below the frame, wherein the first linear motor is disposed below the machine table.

18. A sewing machine as in claim 15, further comprising a plurality of first linear motors spaced apart in the second direction, each linear motor having a first roller engaging the first recess.

19. A sewing machine as in claim 15, wherein the frame further comprises a second recess longitudinally formed in the first direction and the sewing machine further comprises:

a second linear motor comprising a movable member, wherein the second linear motor is adapted to move the frame in the first direction and a second roller disposed on the movable member and engaging the second recess of the frame.

20. A sewing machine as in claim 19, wherein the second linear motor comprises:

a fixed base plate, a stator mounted on the base plate and a linear rail disposed on each side of the stator, wherein the movable member is adapted to move linearly relative to the stator along the linear rails and a gap is magnetically maintained between the movable member and the stator.

21. A sewing machine as in claim 19, further comprising a machine table positioned below the frame, wherein the second linear motor is disposed below the machine table.

22. A sewing machine as in claim 19, further comprising a plurality of first linear motors spaced apart in the second direction and a plurality of the second linear motors spaced apart in the first direction, each first linear motor having a first roller engaging the first recess and each second linear motor having a second roller engaging the second recess.

23. A sewing machine as in claim 15, wherein the sewing machine includes a plurality of sewing heads, each operable to form stitches.

24. An apparatus comprising:

a sewing head;

a frame adapted to move relative to the sewing head in a first direction and a second direction, the first direction being perpendicular to the second direction;

a linear motor coupled to the frame to move the frame in the first direction; and a machine table positioned below the frame, wherein the linear motor is disposed below the machine table.

25. An apparatus as in claim 24, further comprising a plurality of sewing heads, each operable to form stitches.

26. A sewing machine comprising:

a frame adapted to support a fabric;

first means for moving the frame in a first direction comprising a linear motor; and a machine table positioned below the frame, wherein the linear motor is disposed below the machine table.

27. A sewing machine as in claim 26, wherein the frame comprises a first recess and the first means for moving the frame engages the first recess.

28. A sewing machine as in claim 26, further comprising second means for moving the frame in a second direction and comprising a linear motor.

29. A sewing machine as in claim 28, wherein the frame comprises a first recess and a second recess, wherein the first means for moving the frame engages the first recess and the second means for moving the frame engages the second recess.

* * * * *